US006582514B1

(12) United States Patent
Yang

(10) Patent No.: US 6,582,514 B1
(45) Date of Patent: Jun. 24, 2003

(54) CORRECTION TAPE

(76) Inventor: Jacky Yang, Fl. 9, No. 40, Lane 333, Hsin Feng St., Keelung City (TW)

( * ) Notice: Subject to any disclaimer, the term of this patent is extended or adjusted under 35 U.S.C. 154(b) by 0 days.

(21) Appl. No.: 10/127,456

(22) Filed: Apr. 23, 2002

(51) Int. Cl.[7] ..... B05C 17/10

(52) U.S. Cl. ..... 118/76; 118/257; 156/577; 156/579; 242/588.3; 401/17; 401/195

(58) Field of Search ..... 118/76, 257; 156/577, 156/579; 242/588.3; 401/17, 18, 21, 23, 35, 195

(56) References Cited

U.S. PATENT DOCUMENTS 5,310,437 A * 5/1994 Tucker ..... 156/238
5,512,128 A * 4/1996 Manusch et al. ..... 156/577
6,453,969 B1 * 9/2002 Ferrara ..... 156/577
6,461,068 B1 * 10/2002 Holmes ..... 401/17

* cited by examiner

*Primary Examiner*—Laura Edwards
(74) *Attorney, Agent, or Firm*—Rosenberg, Klein & Lee

(57) ABSTRACT

A correction tape is constructed to include a housing formed of a bottom cover shell and a top cover shell, a tape reel mounted on an upright axle in the housing, the tape reel having an upper reel portion and a lower reel portion, a nose wheel mounted in a peripheral opening of the housing, a ratchet; which limits the direction of rotation of the tape reel on the upright axle, a tape of correction material wound round the upper reel portion and lower reel portion of the tape reel and extended through the nose wheel, and fastening adapted for securing the correction tape to a writing implement.

6 Claims, 10 Drawing Sheets

CORRECTION TAPE

BACKGROUND OF THE INVENTION

1. Field of the Invention

The present invention relates to a correction tape and, more specifically, to a simple structure of correction tape, which has means for securing to a writing implement.

2. Description of the Related Art

FIG. 1 shows a correction tape according to the prior art. The correction tape comprises a housing 10, a big wheel 11, a small wheel 12, a big gear wheel 15, a small gear wheel 16, a nose wheel 13, and a tape of correction material 14. The casing 10 comprises two axles 101 and a ratchet 102. The big wheel 11 and the small wheel 12 are respectively mounted on the axles 101. The big gear wheel 15 and the small gear wheel 16 are respectively connected to the big wheel 11 and the small wheel 12 at the bottom side. The big gear wheel 15 has a top pawl 151 engaged with the ratchet 102 to limit the direction of one-way rotation of the big wheel 11 and the small wheel 12. The tape of correction material 14 is mounted on the big wheel 11 and the small wheel 12 and extended through the nose wheel 13. When in use, the nose wheel 13 is pressed on the writing area to be corrected and moved over the writing area to be corrected to turn the tape of correction material 14, causing the correction material of the tape of correction material 14 to be covered on the writing area to be corrected. This structure of correction tape is still not satisfactory in function because of the following drawbacks:

1. Because a big wheel 11, a small wheel 12, a big gear wheel 15, and a small gear wheel 16 are used to achieve correction tape applying and recycling operation, the structure of the correction tape is complicated.
2. The complicated gear transmission structure of the correction tape fits only one tape of correction material.
3. The correction tape is an independent device not mountable to a writing apparatus or the like.

SUMMARY OF THE INVENTION

The present invention has been accomplished under the circumstances in view. It is one object of the present invention to provide a correction tape, which has a simple structure. It is another object of the present invention to provide a correction tape, which is mountable to a writing implement (ball pen, fountain pen, etc.). It is still another object of the present invention to provide a correction tape, which fits multiple tapes of correction material. To achieve these and other objects of the present invention, the correction tape comprises a housing formed of a bottom cover shell and a top cover shell, a tape reel mounted on an upright axle in the housing, the tape reel having an upper reel portion and a lower reel portion, a nose wheel mounted in a peripheral opening of the housing, ratchet means, which limits the direction of rotation of the tape reel on the upright axle, and a tape of correction material wound round the upper reel portion and lower reel portion of the tape reel and extended through the nose wheel. According to another aspect of the present invention, fastening means is provided at one of the cover shells and adapted for securing the correction tape to a writing implement. As alternate forms of the present invention, multiple tape reels are provided inside the housing to hold a respective tape of correction material over a respective nose wheel for application.

DETAILED DESCRIPTION OF THE PREFERRED EMBODIMENT

Figure 1:
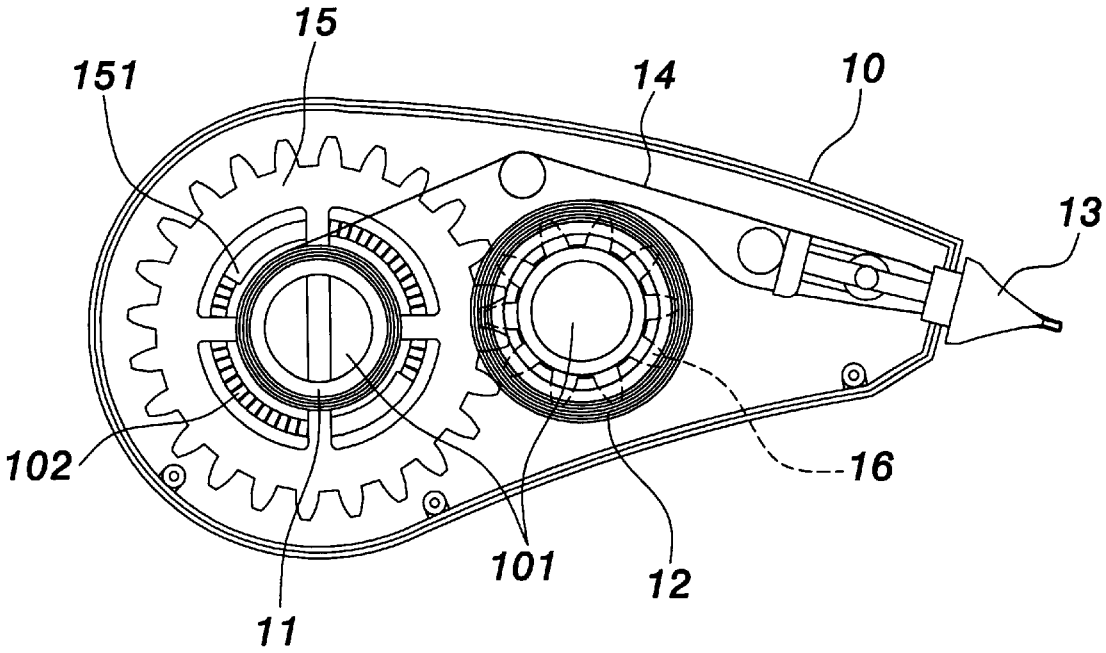
FIG. 1 PRIOR ART
FIG. 1 is a sectional view of a correction tape according to the prior art.
Figure 2:
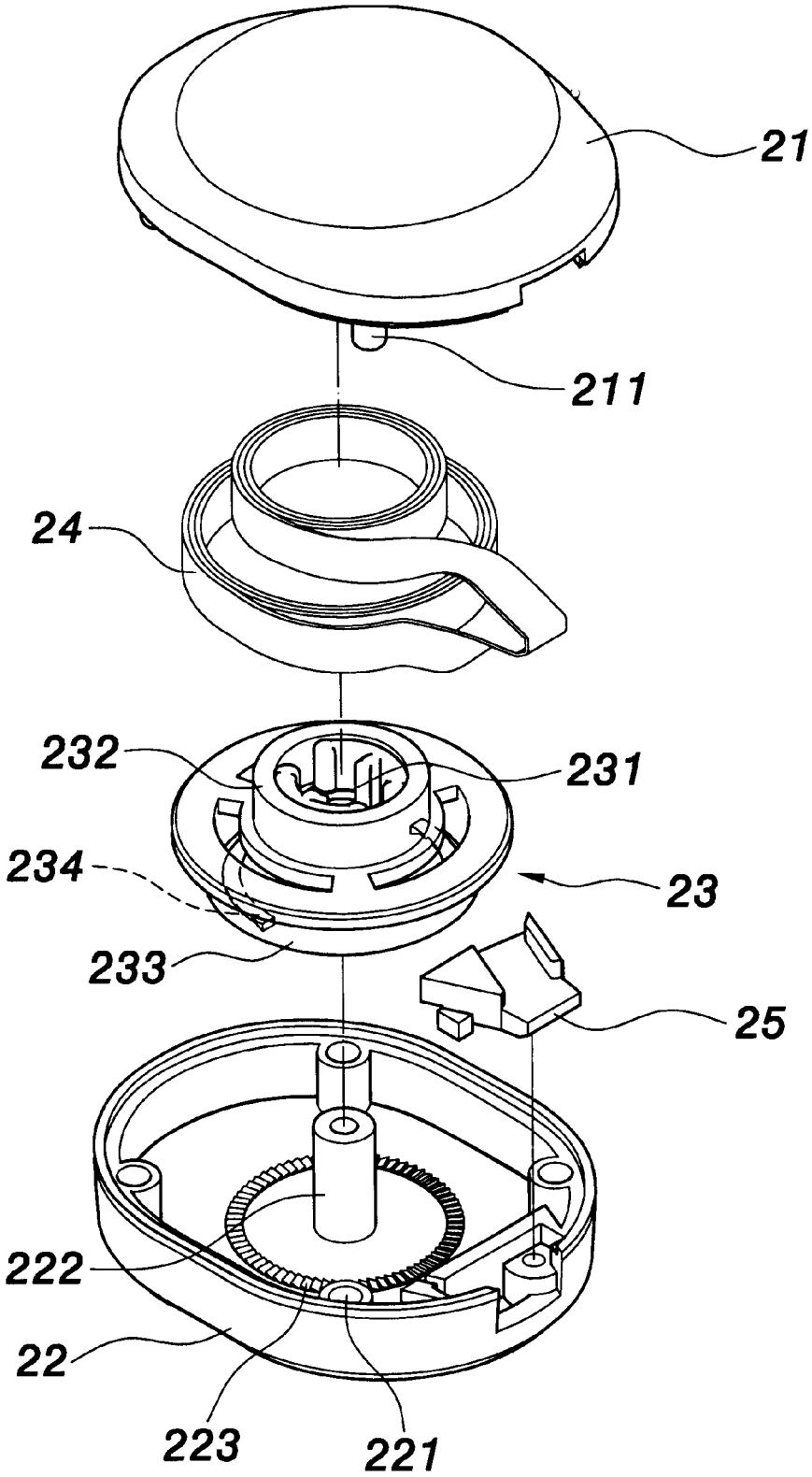
FIG. 2 is an exploded view of a correction tape according to a first embodiment of the present invention.

Referring to FIGS. from 2 through 5, a correction tape in accordance with a first embodiment of the present invention is shown comprised of a top cover shell 21, a bottom cover shell 22, a tape reel 23, a tape of correction material 24, and a nose wheel 25.

Figure 3:
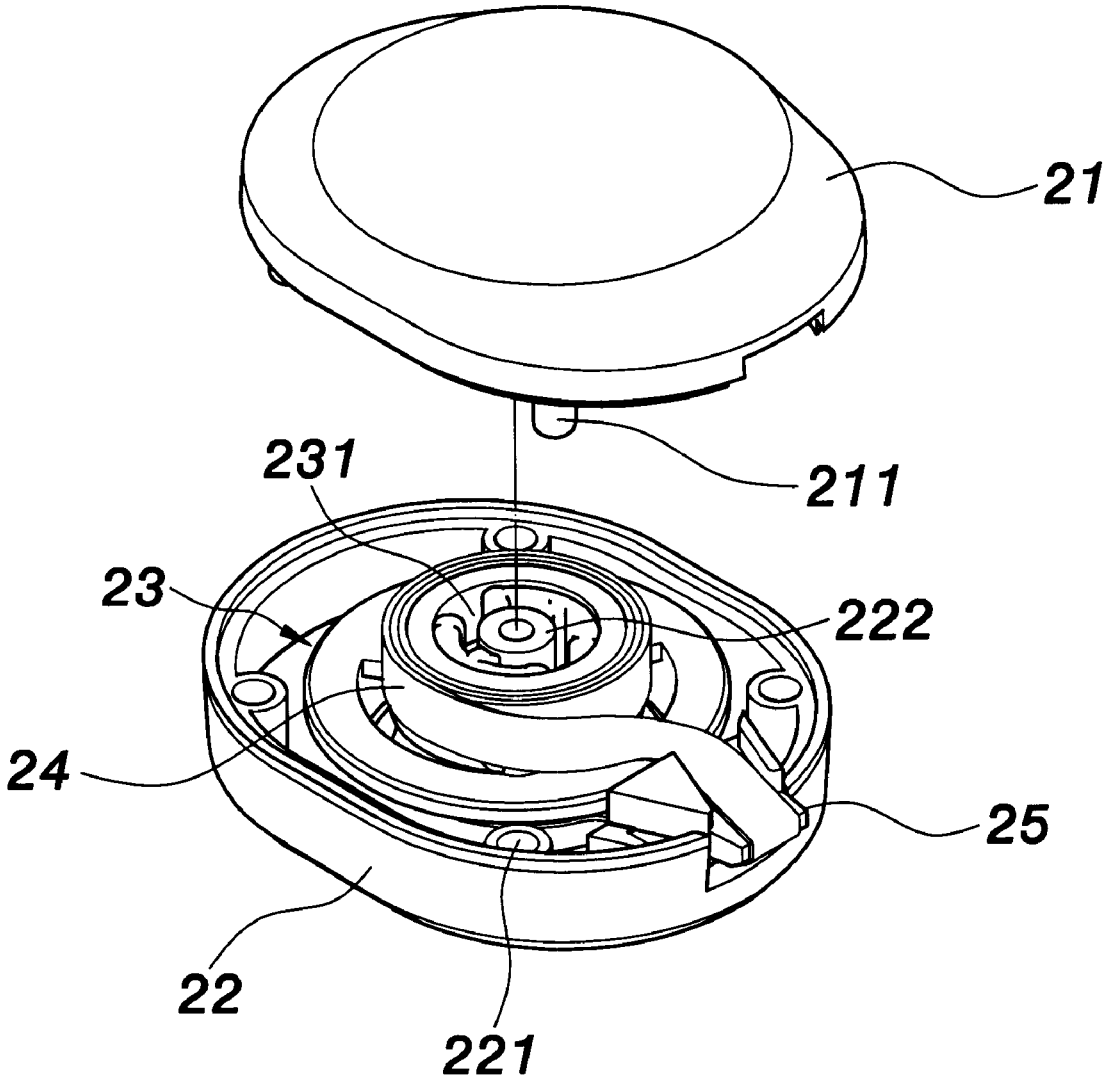
FIG. 3 is an assembly view of the correction tape according to the first embodiment of the present invention before closing of the top cover shell.
Figure 4:
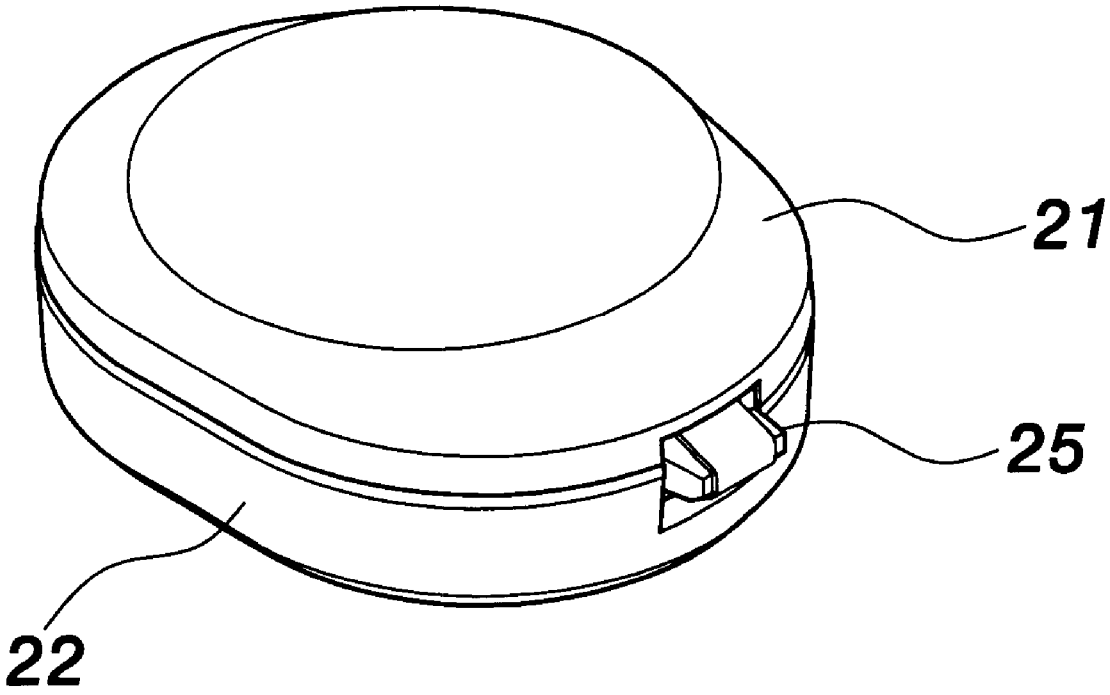
FIG. 4 is an elevational view of the correction tape according to the first embodiment of the present invention.
Figure 5:
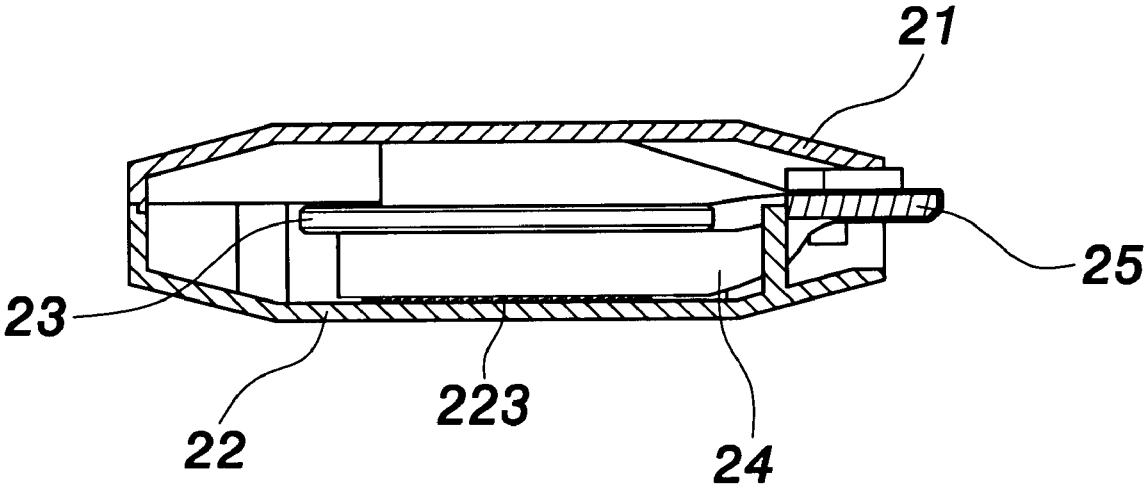
FIG. 5 is a sectional view of the correction tape according to the first embodiment of the present invention.

The bottom cover shell 22 comprises a plurality of plugholes 221 disposed on the inside around the border, an upright axle 222 vertically disposed on the inside at the center, and a ratchet 223 disposed on the inside at the bottom around the upright axle 222. The top cover shell 21 is marked with a trade name or trademark, having a plurality of bottom plug rods 211 corresponding to the plugholes 221 in the bottom cover shell 22. The top cover shell 21 is closed on the bottom cover shell 22 by plugging the plug rods 211 into the respective plugholes 221 (see FIG. 4). The tape reel 23 is mounted on the upright axle 222 inside the bottom cover shell 22 for rotation in one direction, comprising an upper reel portion 232 and a bottom reel portion 233 aligned at different elevations, a center axle hole 231 extended through the center of the upper reel portion 232 and the center of the bottom reel portion 233 and coupled to the upright axle 222 for enabling the tape reel 23 to be rotated on the upright axle 222 to move the tape of correction material 24 over the nose wheel 25 for application (see FIG. 3), and a bottom pawl 234 protruded from the lower reel portion 233 and engaged with the ratchet 223 of the bottom cover shell 22 to limit the direction of rotation of the tape reel 23 on the upright axle 222. The nose wheel 25 is mounted in a peripheral opening of the bottom cover shell 22 to support and guide movement of the tape of correction material 24 for application (see FIGS. 4 and 5). The tape of correction material 24 is of the known art and not within the scope of the present invention. Nor further detail description on the nature of the correction material of the tape of correction material 24 is necessary. The tape of correction material 24 has one end fixedly fastened to and wound round the upper reel portion 232 of the tape reel 23, and the other end extended through the nose wheel 25 and then fixedly connected to and wound round the lower reel portion 233 of the tape reel 23.

Figure 6:
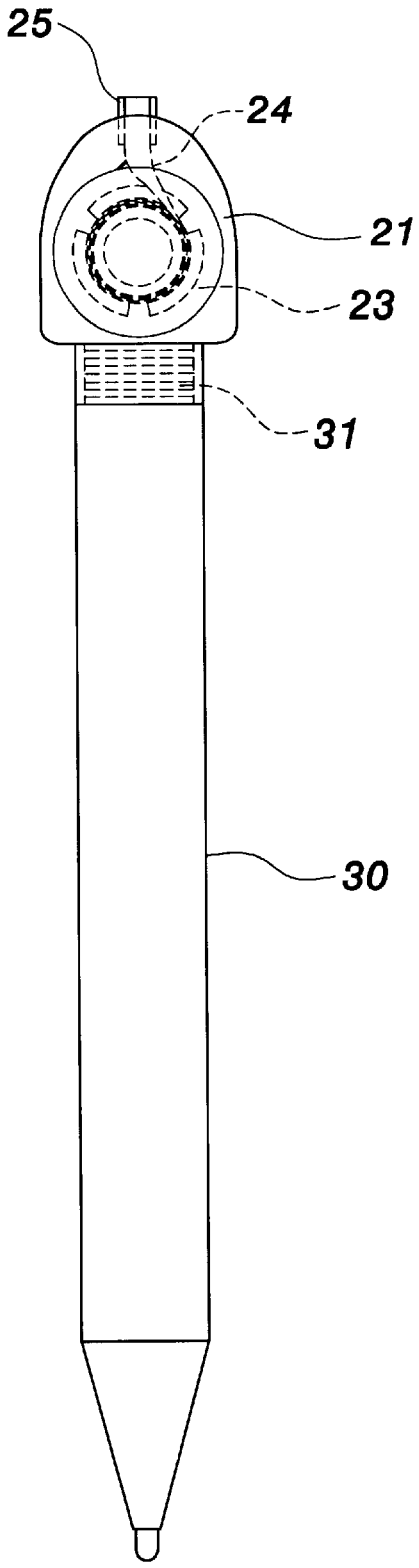
FIG. 6 is a schematic drawing showing the correction tape of the first embodiment of the present invention coupled to a writing implement.

Referring to FIG. 6, the top cover shell 21 (or bottom cover shell 22) is provided with a screw rod 31 for connection to a writing implement 30.

Figure 7:
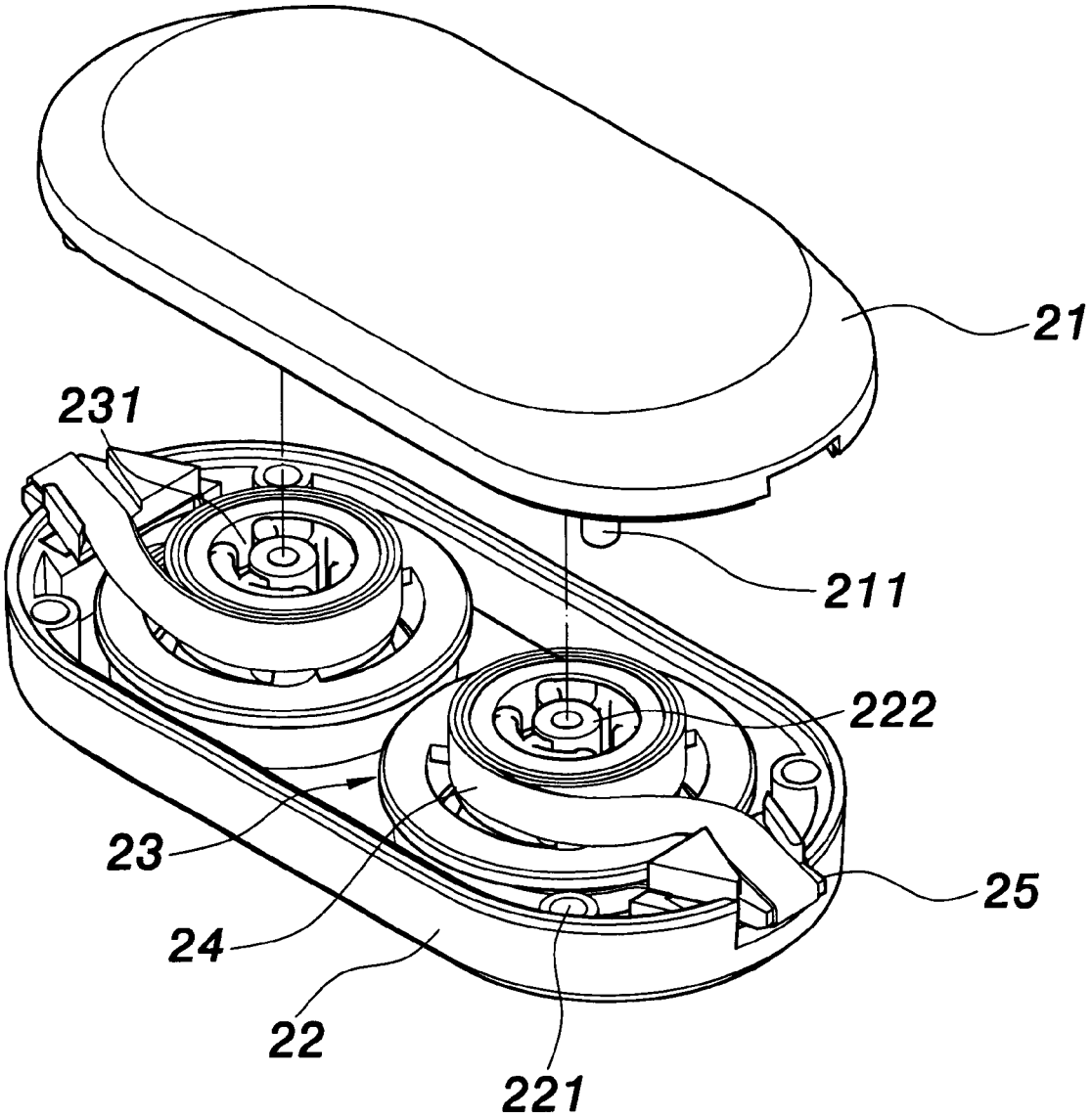
FIG. 7 is an exploded view of a correction tape according to a second embodiment of the present invention.

FIG. 7 shows an alternate form of the present invention. According to this alternate form, comprises a bottom cover shell 22, the bottom cover shell 22 having two upright axles 222 and two ratchets 223 (not shown), and a plurality of plugholes 221, a top cover shell 21 covered on the bottom cover shell 22, the top cover shell 21 having a plurality of bottom plug rods 211 respectively plugged into the plugholes 221 of the bottom cover shell 22, two tape reels 23 are respectively mounted on a respective upright axles 222 inside the bottom cover shell 22, two nose wheels 25 respectively mounted in two opposite peripheral openings of the bottom cover shell 22, and two tapes of correction material 24 respectively mounted in the tape reels 23 and respectively extended through the nose wheels 25.

Figure 8:
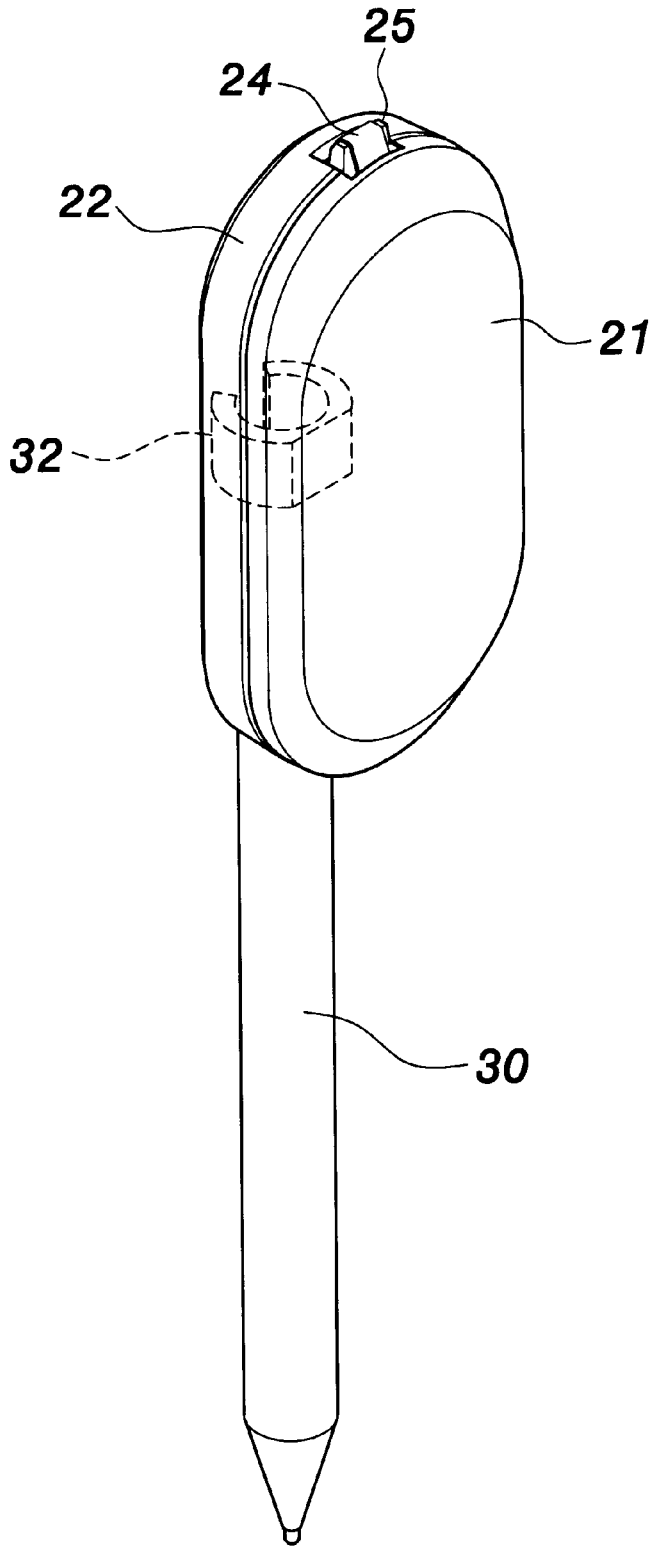
FIG. 8 illustrates the correction tape of the second embodiment of the present invention coupled to a writing implement.

Referring to FIG. 8, the bottom cover shell 22 is provided with a clamp 32 adapted for securing the correction tape to a writing implement 30.

Figure 9:
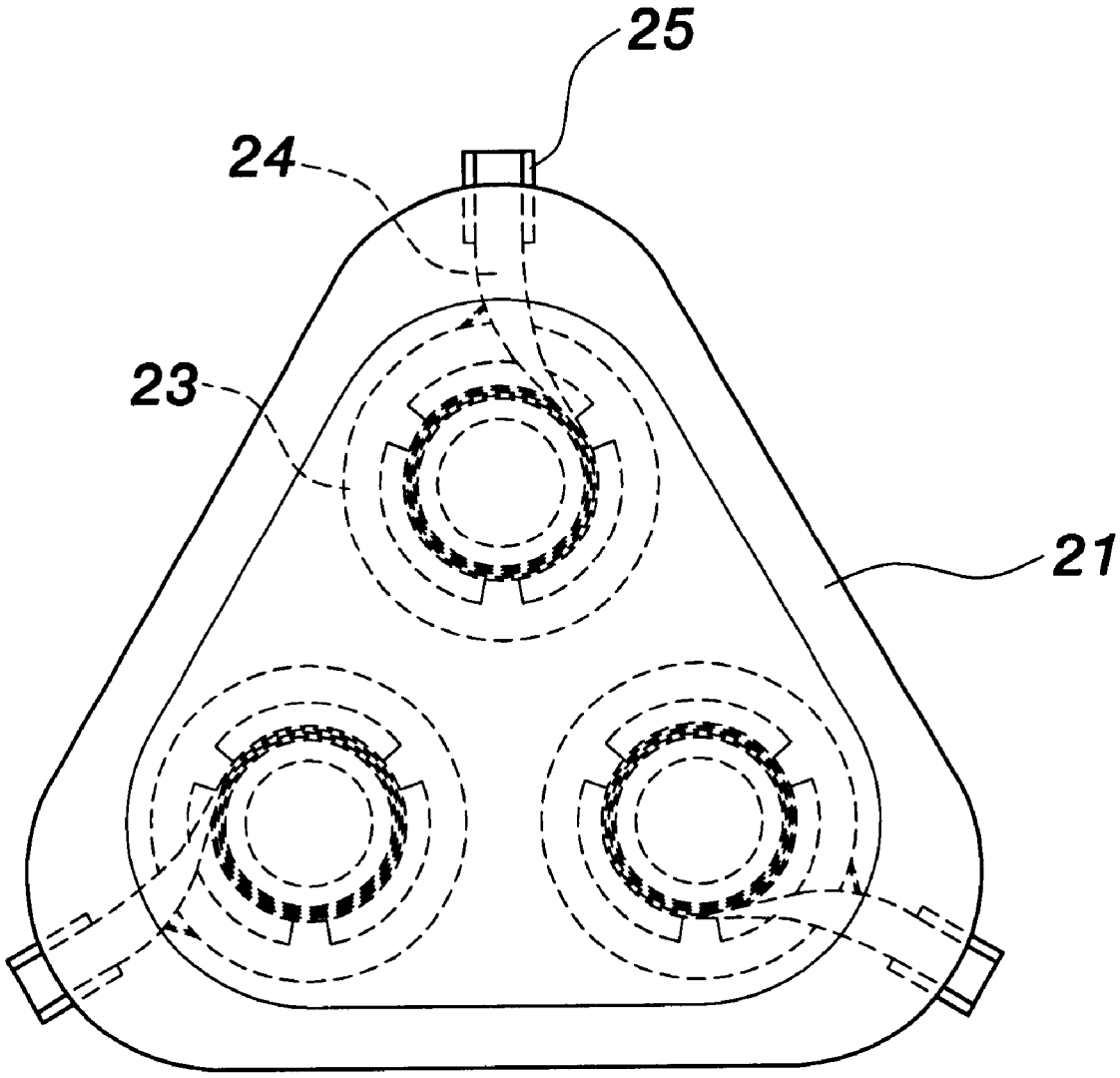
FIG. 9 is a sectional view of a correction tape according to a third embodiment of the present invention.

FIG. 9 shows still another alternate form of the present invention. According to this alternate form, three tape reels 23 are provided in the triangular cover shells 21;22 (the bottom cover shell 22 is not shown) to hold a respective tape of correction material 24 for application.

Figure 10:
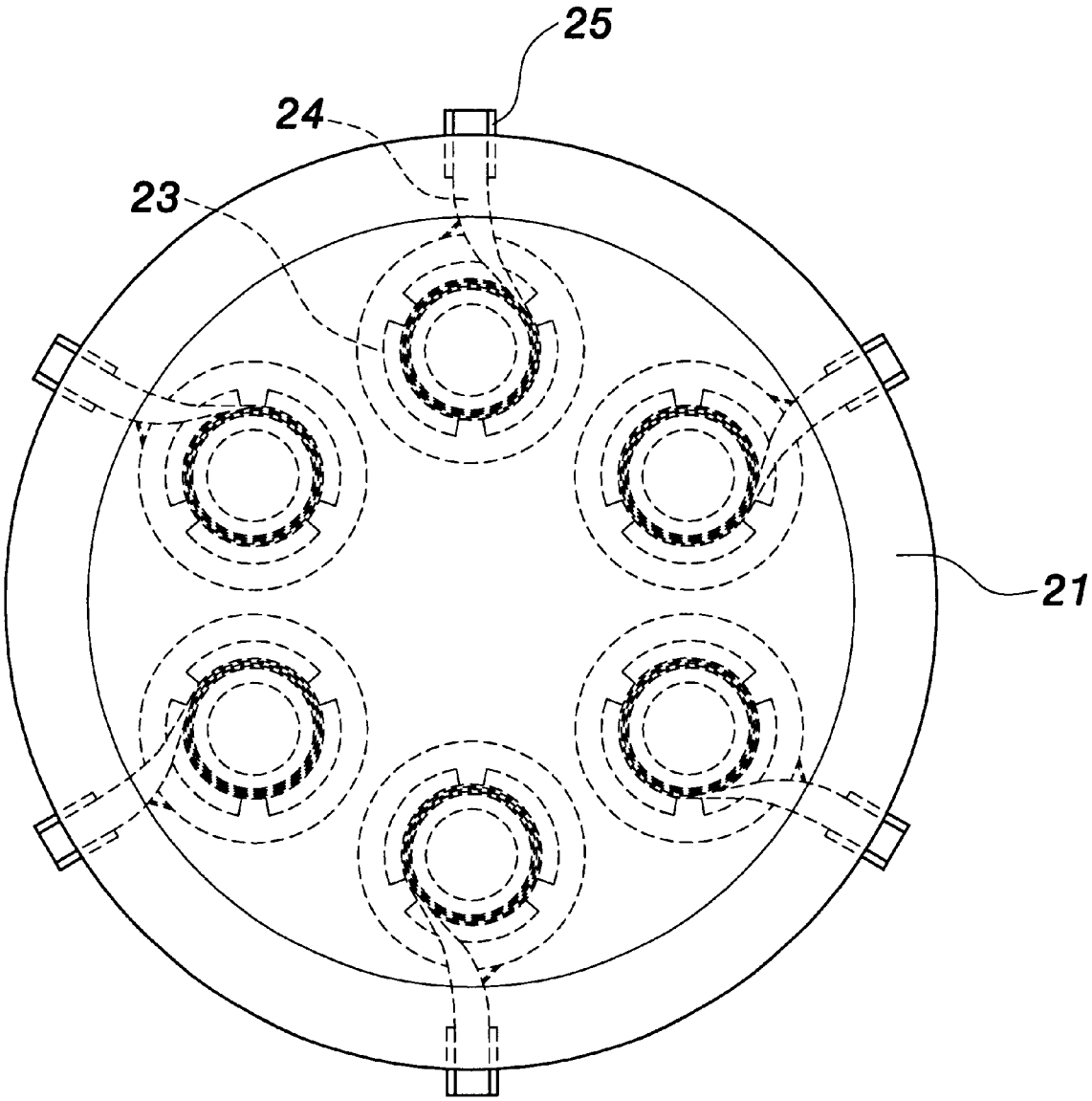
FIG. 10 is a sectional view of a correction tape according to a fourth embodiment of the present invention.

FIG. 10 shows still another alternate form of the present invention. According to this alternate form, six tape reels 23 are provided in the circular cover shells 21;22 (the bottom cover shell 22 is not shown) to hold a respective tape of correction material for application.

A prototype of correction tape has been constructed with the features of the annexed drawings of FIGS. 2~10. The correction tape functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A correction tape comprising:

a top cover shell, said top cover shell having a plurality of plug rods inside around an edge thereof;

a bottom cover shell, said bottom cover shell comprising a plurality of plugholes respectively corresponding to the plug rods, at least one upright axle, and at least one ratchet respectively disposed on the inside around said upright axle;

at least one tape reel respectively mounted on said at least one upright axle inside said bottom cover shell for rotation in one direction, said at least one tape reel each comprising an upper reel portion, a lower reel portion, and pawl means protruded from said lower reel portion and engaged with said at least one ratchet to limit the direction of rotation of the respective tape reel;

at least one nose wheel respectively mounted in said bottom cover shell and partially extended out of said bottom cover shell; and at least one tape of correction material respectively mounted on said at least one tape reel and respectively extended through said at least one nose wheel.

2. The correction tape as claimed in claim 1, wherein said top cover shell is marked with a sign.

3. The correction tape as claimed in claim 1, further comprising fastening means provided in one of said top cover shell and said bottom cover shell for securing the correction tape to a writing implement.

4. The correction tape as claimed in claim 3, wherein said fastening means is a screw member.

5. The correction tape as claimed in claim 3, wherein said fastening means is a clamp.

6. The correction tape as claimed in claim 3, wherein said writing implement is a pen.

* * * * *